United States Patent [19]

Sweeney

[11] Patent Number: 5,011,028

[45] Date of Patent: Apr. 30, 1991

[54] ADJUSTABLE ARROW HOLDER

[76] Inventor: Donald C. Sweeney, South 9417 Freeman Rd., Medical Lake, Wash. 99022

[21] Appl. No.: 487,835

[22] Filed: Mar. 5, 1990

[51] Int. Cl.[5] ..... A47F 7/00

[52] U.S. Cl. ..... 211/60.1; 211/207

[58] Field of Search ..... 211/60.1, 69, 69.1, 211/62, 70.3, 70.6, 207, 187; 248/59, 327; 224/916

[56] References Cited

U.S. PATENT DOCUMENTS

| | | | |
|---|---|---|---|
| 307,193 | 10/1884 | Hazelton | 211/62 |
| 492,359 | 2/1893 | Merker | 211/62 |
| 1,290,290 | 1/1919 | Morio | 211/62 |
| 3,863,879 | 2/1975 | Herb | 248/327 |

*Primary Examiner*—Carl D. Friedman
*Assistant Examiner*—Derek J. Berger
*Attorney, Agent, or Firm*—Keith S. Bergman

[57] ABSTRACT

A holder for sorting, classifying and storing groups of various types of arrows provides a solid base with an arrow head support plate defining plural cells immediately thereabove. Spacedly related vertical supports extending upwardly from the base and through the head support plate to carry an arrow shaft support plate, defining orifices in similar array to those of the arrow head support plate, to support the shank of an arrow spacedly above the base. The vertical supports are threaded at each end to releasably interconnected to both the base and support plates to provide a holder with means for adjustment of the vertical position of both support plates to provide various support configurations.

3 Claims, 1 Drawing Sheet

ADJUSTABLE ARROW HOLDER

BACKGROUND OF INVENTION

1. Related Applications

There are no applications related hereto heretofore filed in this or any foreign country.

2. FIELD OF INVENTION

My invention relates generally to a holder for archery arrows, and more particularly to such a holder that has two adjustable vertically spaced arrow support plates defining paired opposed cooperating cells to carry a plurality of arrows therebetween.

3. BACKGROUND AND DESCRIPTION OF PRIOR ART

Though archery has been known since man's early history, it has remained a viable activity into the modern day. The field has had continued development through its historicity until in the modern day it is most complex and sophisticated. This is especially true of arrow development which has brought about a multitude of different types of arrows with specialized structures and configurations adapted for particular purposes. The development of holders for such arrows that allow sorting, maintenance and storage of those arrows does not appear to have kept pace with the sophisticated development of the arrows themselves. The instant invention seeks to provide such a holder.

Present day archery arrows vary widely in their form and configuration, especially in head type and size, in shaft length, stiffness and size and in fletching type, configuration and size. By reason of this, a modern archer commonly has many sets of various types of arrows. It is most desirable that arrows of a similar type should be classified and associated with each other. This commonly has not heretofore been particularly accomplished, as most arrow storage has been in bucket-like containers where a plurality of arrows are communally maintained in generally unordered array and without any classification or segregation of either individual arrows or types of arrows. My invention resolves this problem by providing an orderly defined array of storage cells to contain groups of similar arrows in adjacent sets while yet maintaining all such different sets in ordered array.

The fletching of arrows has presented additional problems in arrow storage, as fletching not only is of a variety of types and configurations, but also is relatively delicate by nature. Feather structures of various sorts are still used in fletching arrows, as they have been since times immemorial, and those feather structure remain quite delicate by reason of the nature of the feathers themselves, even though in modern times various coatings and other additives have been developed to aid the stability of feather fletching against physical abuse. In recent times, various polymeric materials, generally of a relatively thin sheet-like nature, have been used for fletching arrows, but these structures, even though more durable than most feather structures, still are quite delicate of nature and easily damaged by physical contact with other objects or by only very minor abuse. Storage devices heretofore known that do not store arrows in some fashion wherein the fletchings of the various arrows are physically separated from contact with each other or with external objects generally have not protected the relatively delicate fletchings. The instant invention does protect such fletchings by maintaining arrows in a vertical orientation and an ordered matrix type array with adjacent arrows spaced from each other sufficiently that one arrow will not damage the fletching of another or allow contact of an arrow's fletching with external structures or with the support itself.

Archery arrows have a head of some sort, and these head structures come in a multitude of configurations and forms ranging from the blunt, oblately spheroidal structure of a stunning arrow through the traditional bullet shaped head to fluted and tined heads having sharp points and radially projecting flukes of various sorts. Many of these head structures have cross-sectional size substantially larger than an arrow shaft, and many are of a relatively delicate nature to require substantial care in their support to keep them from being physically damaged or keep them from physically damaging persons or things with which they might come into contact. Bucket-type holders of the past generally have not addressed this problem at all and have had no means to preserve the integrity of arrow heads. One heretofore known type of supporting and holding device for arrows has provided resiliently deformable groove structures that engage about an arrow shaft in one or more places to hold the arrow. These devices in general have held only a very few arrows and have not been particularly reliable or convenient because of their reliance on the deformable dependency of the material from which they are constituted, which oftentimes changes and does not provide appropriate strength or rigidity to well serve its purpose. My invention in contradistinction resolves this problem by carrying arrows in vertical orientation in a spaced, substantially parallel array with their heads downwardmost and each arrow individually supported in cell-like structures created specifically for that purpose to maintain an ordered spaced relationship of arrows.

The length of arrow shafts used in modern day archery may also vary significantly from shorter type arrows used with crossbows that oftentimes are seven to nine inches in length to longbow arrows that may range to upwards of thirty inches in length. Most arrow holders of the past have disregarded this problem by placing arrows of various lengths in bucket-type holders which allows the arrows to physically damage each other, or in the case of resiliently deformable holding structures by using only one such structure for an arrow or requiring close spacing of adjacent holders, either of which may again not adequately physically protect the arrows being held. My invention resolves this problem by providing support columns, joining the lower base and head holding structure with the upper shaft holding structure, that are of a threaded type and interconnected to support plates by bolts and washers to allow adjustable positioning of an upper holding structure relative to the base structure to appropriately accommodate arrows of varying lengths.

This structure also allows various configurations of the support structure such as by providing plural shaft support plates at different vertical distances above a head support plate and in allowing angulation of the head support plate, shaft support plate, or both.

My invention resides not in any one of these features per se, but rather in the synergistic combination of all of the structures of my invention that give rise to the functions necessarily flowing therefrom, as herein specified and claimed.

SUMMARY OF INVENTION

My invention generally provides a planar rigid base carrying at least one and preferably three or four vertical supports spaced about its periphery to extend a spaced distance vertically thereabove. The vertical supports are threaded in their end portions and extend through the base and two arrow support plates to releasably and adjustably fasten the base and immediately upwardly adjacent lower arrow head support plate and a spacedly upwardly adjacent upper arrow shaft support plate by means of pairs of nuts carried by the supports on opposite sides of the supported plates. Both the lower head support plate and upper shaft support plate define a plurality of similarly spaced orifices to cooperate to support the head and shaft of arrows extending therebetween. The orifices defined in the arrow shaft support plate are of size sufficient to allow the passage of the head of an arrow to be supported therein, and the distance between the two support plates is less than the distance from the point of an arrow to the most adjacent portion of its fletching.

In creating such a device, it is:

A principal object of my invention to provide a holder for classifying and maintaining a plurality of archery arrows of various types in a vertically upstanding, easily releasably orientation.

It is a further object of my invention to provide such a holder that adjustably supports an arrow shaft holding plate spacedly above an arrow head holding plate to allow adjustable positioning of the two plates relative to each other to accommodate arrows of varying lengths and display them for easy access.

A further object of my invention is to provide such a holder that maintains arrows in spacedly adjacent cells in each support plate, to prevent damage to particular arrows by contact with other arrows or by contact with physical objects and also to prevent the arrows from physically damaging people or objects.

A still further object of my invention is to provide such a device that is of new and novel design, of rugged and durable nature, of simple and economic manufacture and otherwise well suited to the uses and purposes for which it is intended.

Other and further objects of my invention will appear from the following specification and accompanying drawings which form a part hereof. In carrying out the objects of the invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
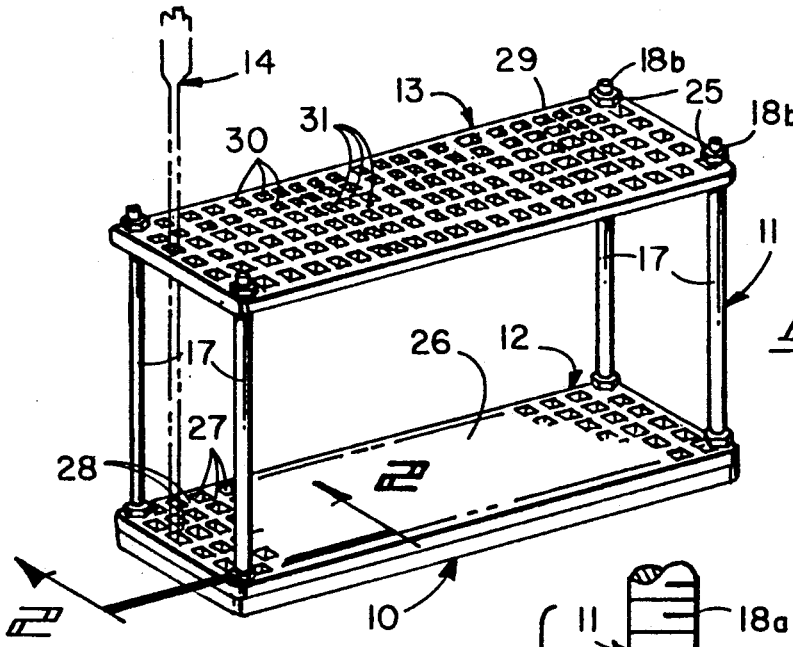
FIG. 1 is an isometric view of an arrow holder showing its various parts, their configuration and relationship.
Figure 2:
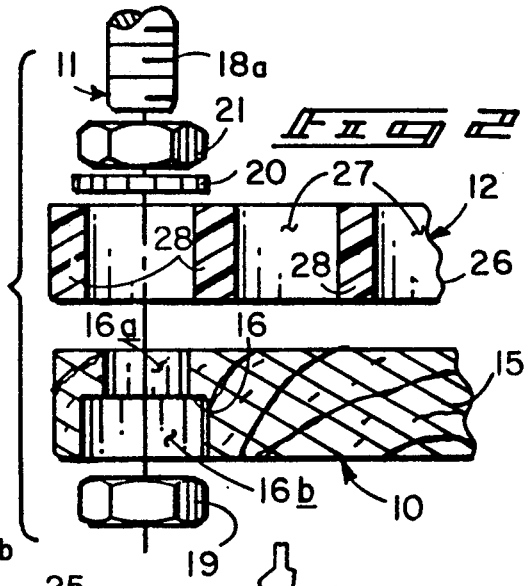
FIG. 2 is an enlarged and expanded partial orthographic view of the interconnection of a vertical support with the base and arrow head support plate.
Figure 3:
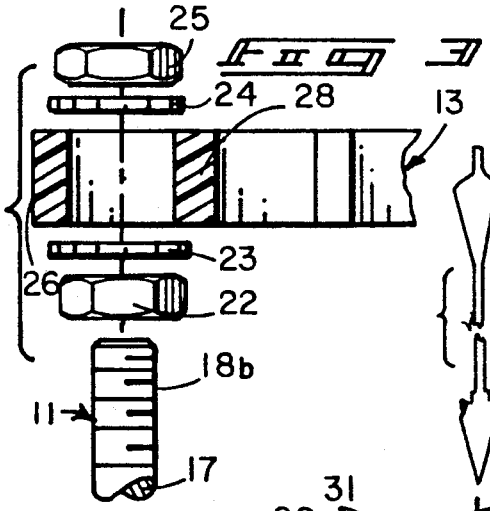
FIG. 3 is an enlarged and expanded partial orthographic view of the interconnection of a vertical support with the arrow shaft support plate.

My arrow holder generally provides base 10 supporting vertical supports 11 to extend upward from the base to interconnect lower arrow head holder plate 12 immediately above the base and upper arrow shaft holder plate 13 spacedly thereabove to support arrows 14 in vertical orientation between the holder plates.

Base 10 provides flat base plate 15 formed of some rigid relatively softer material such as wood that provides appropriate rigidity for the holder structure but yet is not hard enough to damage arrow points. In the form of arrow holder illustrated, the base plate is of rectilinear peripheral configuration, though this is not essential to my invention and the base plate peripheral shape may be circular, arcuate or of other form. The base plate defines at least one and preferably four holes 16, spacedly arrayed about its periphery, in positions that are spacedly inward of the periphery. The holes 16 illustrated are of a compound nature with a diametrically smaller upper portion **16*a* to receive the shaft of a vertical support and a diametrically larger lower portion 16*b*** to receive a nut fastening a vertical support in a counter-sunk fashion so that the nut will not project downwardly below the lower surface of the base. Both upper and lower surfaces of the base are substantially coplanar to allow support on an underlying planar surface and also allow appropriate intercommunication with a planar arrow head holder plate immediately above the base.

Vertical supports 11 each provide elongate rod 17 threaded at least in its end parts 18 to allow releasable and adjustable interconnection of the base and support plates. The major external diameter of shaft 17 is substantially the same size as holes 16 defined in base element 15. The lower threaded portion **18*a* of the support shaft 17 is carried in hole 16 of the base member so that the lower end of the support shaft is substantially coplanar with the lower surface of the base member. This lower threaded portion is positionally maintained in this relationship by nut 19 engaged on the lower threaded portion 18*a* of the support with the nut 19 carried in larger portion 16*b* of hole 16. This nut 19 maintains the support rod only against upward motion in the hole, so a second annular washer 20 and lower medial nut 21 are threadedly engaged on lower threaded portion 18*a* immediately above the upper surface of lower arrow head holder plate 12 when that plate is operatively positioned on the upper surface of base 10. With this structural relationship and these two nuts 19, 21 tightened to create force between them, the vertical support rod 17 will be releasably positioned to extend vertically upwardly from base 10** and will also positionally maintain the lower arrow head holder plate upon the base.

Upper threaded portion **18*b* of support rod 17 supports the upper arrow shaft holder plate 13 in similar fashion. Upper medial nut 22 is threadedly engaged on threaded portion 18*b* of the support rod, spacedly inwardly from the upper end of the rod. This nut 22 carries annular washer 23 immediately upwardly adjacent thereto to fastenably contact the lower surface of the upper arrow shaft holder plate. To accomplish its purpose, this washer 23 will have to have a major diameter at least slightly greater than the size of the orifice in which the associated support rod is carried. The upper threaded portion 18*b* of the support rod then extends through an appropriate hole defined in the upper shaft holder plate and washer 23 is positioned about the rod and above the upper surface of the upper arrow shaft holder plate. Upper nut 25 is then threadedly engaged on the uppermost threaded portion 18*b* of rod 17 and tightened to create force between the two upper nuts 22, 25 to interconnect the vertical support to the upper arrow shaft holder plate The number of vertical supports 11** used with my invention is not limited by the essence of the invention, and one such element will fulfill the purposes of the invention. For practical operation, however, a minimum number of two such vertical supports should be used so that the upper arrow shaft holder plate will be more rigidly supported against displacement in other than a cantilevered fashion. In the instance illustrated, four vertical supports are shown and this configuration is the preferred embodiment. These vertical supports and their accessory connectors preferably are formed from metal to provide appropriate rigidity and durability, but other rigid material, such as the harder and more dense plastics, may service this purpose, if not so well.

Lower arrow head holder plate 12 is a flat, planar element 26 of substantially the same peripheral configuration and dimension as the base 10, and of appropriate thickness to define orifices 27 to positionally maintain the heads of arrows when placed therein, especially as against somewhat horizontally directed forces tending to dislocate the arrows. Commonly, orifices 27 will be defined in a rectilinear array, as illustrated, though this is not of essence to my invention and other arrays may be used. The size and configuration of the orifices is not critical, but the generally square-shaped type orifice illustrated is preferred with a side dimension of approximately 0.6 inch (1.5 cm). This type of orifice will generally receive most commonly used arrow heads, except for some fluted and blunt stunning type arrows that may have enlargements in their head parts that are of greater major dimension than 0.6 inch.

With large headed arrows, it may be necessary to define larger orifices in the holder plates to appropriately service them. This can be done in a structure having smaller orifices by joining an adjacent group of smaller orifices by removing the septa between them to create one single larger orifice. Commonly with 0.6 inch orifices, if the septa between four immediately adjacent orifices that have common corners are removed, the resulting orifice is of appropriate size to receive and allow passage therethrough of most common stunning and fluted type arrowheads. The thickness of head holder plate 26 is not critical, but preferably is approximately 0.4 inch (1.0 cm) to prevent most accidental arrow head dislodgement. This lower head holder plate is preferably formed of one of the more dense, rigid and durable plastic materials, commonly by molding or stamping from sheets of such material. In the dimensions and configurations commonly used in my holder, such holder elements may be found in various light fixture gratings that are commonly used to somewhat columnate light passing therethrough. This light fixture grating makes a convenient source for obtaining arrow holding plate elements without having to manufacture them specifically for the purpose of my holder.

Commonly, holes 16 defined in the base will be so positioned as to be immediately beneath one of the orifices defined in lower arrow head holder plate 12, but if this not be the case, appropriate holes (not shown) are defined in this plate to allow passage of vertical supports 11 therethrough. The thickness of septa 28 between orifices 27 should be appropriate to space arrows carried in those orifices sufficiently distant from each other to avoid damaging contact of the parts of arrows 14 being held, and that thickness commonly will be accomplished with the dimensioning indicated if the septa are approximately 0.25 inch (0.6 cm) wide.

Upper arrow shaft holder plate 13 provides flat, planar element 29 of peripheral shape substantially similar to an associated lower arrow head holder plate and base plate. Planar element 29 defines a plurality of orifices 30 in similar array to those defined in lower arrow head holder plate 26, so that orifices in the upper holder plate have a one-to-one relationship with corresponding orifices in the lower holder plate to support an arrow resting in two cooperating orifices in substantially vertical orientation. In general for use with most arrows, septa 31 between adjacent orifices 30 will be substantially the same size as septa 28 between orifices defined in planar element 26.

Figure 4:
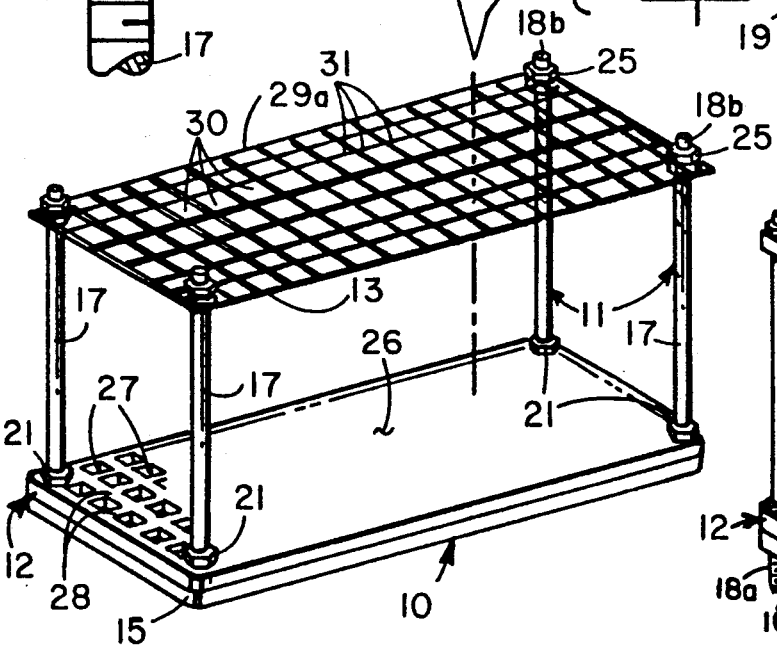
FIG. 4 is an isometric view of an arrow holder having an arrow shaft support plate formed of wire mesh to provide larger cells to support broad-headed arrows.
Figure 5:
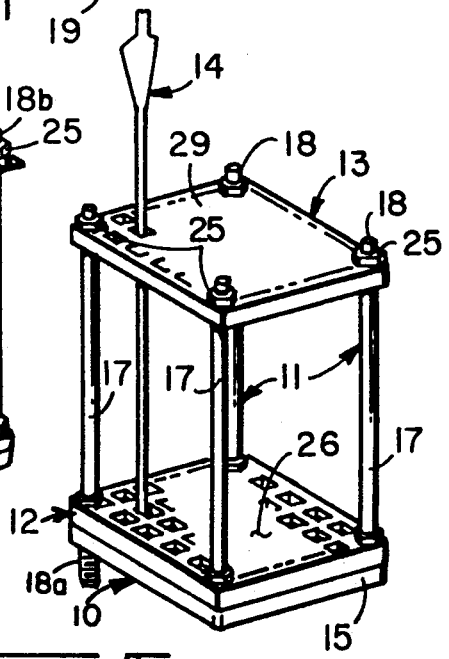
FIG. 5 is an isometric view of a smaller form of my invention showing some longer vertical supports to position the arrow support plates at an angle to a supporting surface.

If larger-headed arrows such as broad heads having flukes or stunning arrow are to be carried by my invention, the septa between orifices in the upper shaft holder may be smaller than required to allow passage of an arrow head. A species of invention shown in FIG. 4 illustrates the use of a screen-type upper plate **29*a* that has relatively small wire-like rods 31 forming its septa 30. If still larger orifices are required, the septa between adjacent orifices may be removed, as indicated for the lower head holder, to create larger orifices. It may be necessary to define holes for vertical supports in the upper shaft holder and if so, those holes are defined. As previously indicated the holes in the base plate will commonly be so positionally defined as to allow use of existing orifices in both the lower head holder plate and also the upper shaft holder to allow extension of vertical supports 11** therethrough.

Upper arrow shaft holder plate 13 preferably is of a thickness substantially the same as lower arrow head support plate 12, if the element be formed of plastic materials, and the thickness will be relatively nominal if the shaft holder plate be formed by wire-like elements interconnected to form a screen, such as illustrated in FIG. 4.

Having described the structure of my invention, its use may be understood.

Firstly, a holder is formed according to the foregoing specification and assembled as described and illustrated. The length of vertical supports 11 will be appropriate, with fastening adjustment, to create a distance between the lower arrow head holding plate and the upper arrow shaft holding plate that is somewhat less than the distance from an arrowhead to the forward portion of its fletching, but preferably not too much less. If the upper and lower holding plates be spaced too close to each other, this allows greater angulation of the upper portion of arrows that are held within cooperating orifices defined in the two plates and thusly requires greater spacing between orifices to prevent the upper portions of arrows from physically contacting and damaging adjacent arrows.

With the holder so assembled, it is placed on some reasonably flat and level surface, and then is ready for use. To use the holder, arrows are manually inserted tip first through an orifice in upper arrow shaft holder plate 13 and moved downwardly therethrough until the point of the arrow is engaged within a cooperating orifice defined in lower arrow head holder plate 12. The arrows in the holder are then maintained in vertical orientation and in spaced adjacent array so that they do not physically contact each other to cause damage to other arrows or to external objects or persons. The arrows will be contained against external forces, especially such forces that are somewhat horizontally oriented, but obviously the holder cannot be turned too far from the vertical and yet properly fulfill its purpose. The holder is designed primarily for storage of arrows during periods of non-use or during use periods at some fixed position, such as at an archery range.

It should be particularly noted from the foregoing description that various areas or portions of either or both lower head holder and upper shaft holder may be particularly identified with some indicia, such as colored markings, orifice shape or the like, to readily identify holder area where particular groups of arrows may be established.

It is further to be noted that arrows are not held or maintained in my holder by reason of any elastic resilience and therefore none of the holder elements characteristics are subject to change by reason of passage of time or by use, as are most elastically or deformably resilient materials.

It should further be noted that my holder may be formed to hold any desired number of arrows, but commonly a holder of a dimension of seven or eight inches in width and eighteen to twenty-four inches in length, that holds between one hundred and two hundred arrows, is most commonly desirable.

It should further be noted that if arrows of substantially different lengths are to be used, the upper arrow shaft holder plate 13 might be formed as two or more separate elements with additional vertical supports 11 added to the structure to maintain the several arrow shaft holder plates at different heights above the same base to allow proper support of arrows of substantially different lengths. It should also be noted that vertical supports on one side of the holder may be longer than those on the opposite side and may extend beneath the base to cause the arrow holder plates to be angularly positioned relative to a surface holding the holder to allow better vision and easier selection of arrows carried in the holder.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A holder for archery arrows, that maintains individual arrows in spaced, vertical array, comprising in combination:

a base having a solid rigid, planar base plate defining at least four vertical support holes extending herethrough for releasable interconnection of a vertical support element;

at least four vertical support elements communicating with each vertical support element hole defined in the base to extend vertically upwardly a spaced distance above the base, each said vertical support having threaded upper and lower end portions, and each said threaded end portion carrying spacedly adjacent nuts;

a lower arrow head holder plate comprising a rigid planar holder plate defining a plurality of spacedly arrayed arrow head holding orifices with orifice defining septa between adjacent orifices, holes for passage of the vertical support elements therethrough, and a peripheral shape substantially the same as the base, said arrow head holder plate positioned immediately above the base with a first nut carried by the lower threaded portion of the vertical support elements on the undersurface of the base and the adjacent nut carried by the same threaded end portion of the same vertical support element on the upper surface of the arrow head holder plate; and an upper rigid arrow shaft holder plate having a rigid planar element defining a plurality of spaced arrow holding orifices defined by septa between adjacent orifices, said orifices arrayed similarly to the orifices defined in the lower arrow head holder plate to support an arrow extending between both said holder plates in substantially vertical orientation, holes for passage of the vertical support elements therethrough, and a peripheral shape substantially the same as the base, said arrow shaft holder plate carried by the vertical supports extending therethrough with a first nut carried by the upper threaded portion of the vertical support elements positioned on the undersurface and a second nut carried by the same upper threaded portion of the same vertical support element positioned on the upper surface of the arrow shank holder plate in fastening adjacency therewith.

2. The apparatus of claim 1 further characterized by:

the peripheral shapes of the base, arrow head holder plate, and arrow shaft holder plate being substantially rectangular and the vertical support elements being four in number and spacedly arrayed about the periphery of the base.

3. The invention of claim 1 further characterized by:

the septa between adjacent orifices defined in the lower head holder plate and in the upper arrow shaft holder plate being formed of rigid material that may be severed and removed to create larger orifices to allow passage and support of large headed arrows.

* * * * *